United States Patent [19]

Kranc et al.

[11] 4,047,664

[45] Sept. 13, 1977

[54] ACCUMULATOR TYPE INJECTION VALVE INCLUDING A DUMP VALVE FOR FAST RESPONSE

[75] Inventors: Stanley J. Kranc, Morton; Alan W. Wells, Edelstein; David E. Hackett, Washington, all of Ill.

[73] Assignee: Caterpillar Tractor Co., Peoria, Ill.

[21] Appl. No.: 669,363

[22] Filed: Mar. 22, 1976

[51] Int. Cl.[2] ..... B05B 1/28

[52] U.S. Cl. ..... 239/120; 239/533.9

[58] Field of Search ..... 239/88, 89, 90, 96, 239/120, 533.9

[56] References Cited

U.S. PATENT DOCUMENTS

| | | | |
|---|---|---|---|
| 2,985,378 | 5/1961 | Falberg | 239/96 |
| 3,598,314 | 8/1971 | Bailey et al. | 239/96 |
| 3,948,446 | 4/1976 | Goyal | 239/120 |

*Primary Examiner*—Evon C. Blunk
*Assistant Examiner*—Michael Mar
*Attorney, Agent, or Firm*—Phillips, Moore, Weissenberger, Lempio & Majestic

[57] ABSTRACT

An accumulator type injection valve of simple construction and relatively large accumulator capacity has opposed inlet and outlet valves for alternately and intermittently communicating a single chamber with an inlet passage for receiving fuel from a pump and an outlet passage in further communication with an injection nozzle, the outlet valve being an inwardly opening needle valve responsive to fluid pressure within the chamber. In order to even further improve operating response of the injection valve, a dump valve relieves fluid pressure from the chamber below a preselected pressure.

8 Claims, 1 Drawing Figure

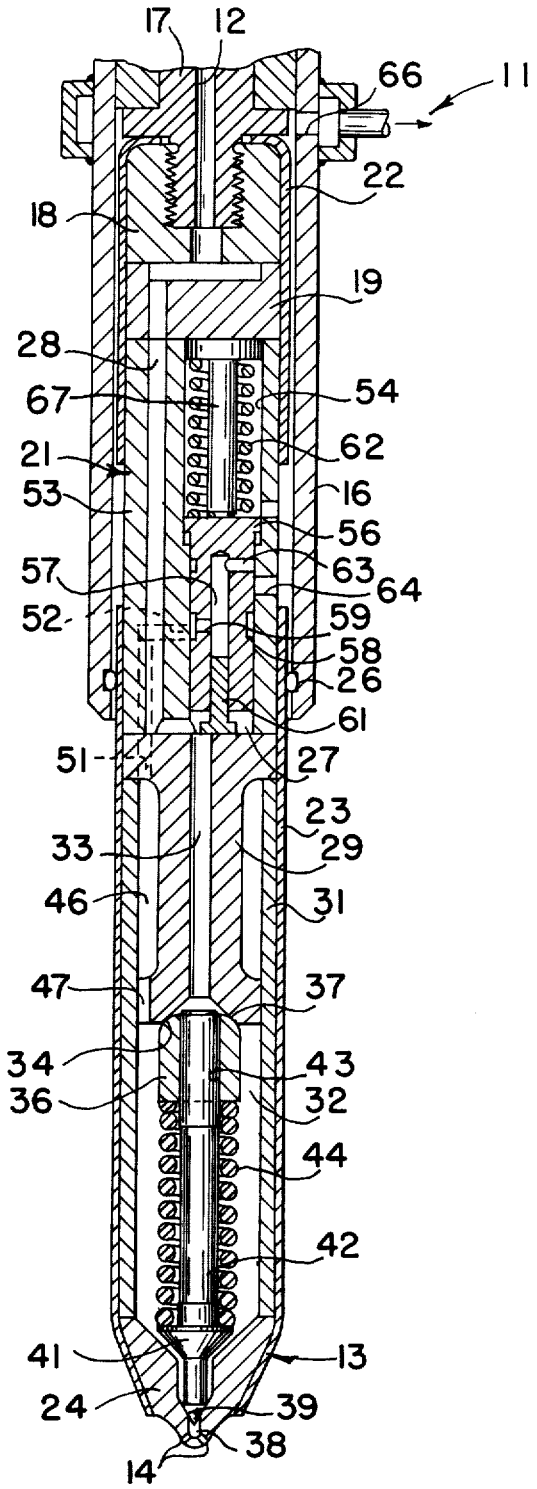
17
12
66
11
22
18
19
28
67
54
21
62
53
16
56
57
63
64
52
59
58
26
61
51
27
23
33
29
46
31
47
37
34
43
36
32
44
42
41
13
24
39
38
14

ACCUMULATOR TYPE INJECTION VALVE INCLUDING A DUMP VALVE FOR FAST RESPONSE

CROSS REFERENCE TO RELATED APPLICATION

Cross reference is made to a related application entitled "Accumulator Fuel Nozzle with Dump Valve" to Clifford L. Richter, issued on Sept. 28, 1976, as U.S. Pat. No. 3,982,694, and assigned to the Assignee hereof.

BACKGROUND OF THE INVENTION

The present invention is directed toward an accumulator-type fuel injection valve and more particularly toward such a valve wherein a single chamber is employed as both a valve chamber and an accumulator chamber to provide increased accumulator capacity while achieving simplicity of construction within the valve as well. Preferably, the fuel injection valve also includes a dump valve for relieving fluid from the chamber below a preselected pressure level in order to improve operating response of the injection valve.

The prior art is exemplified, for example, by U.S. Pat. No. 3,788,546, which discloses a typical fuel injection valve, as well as U.S. Pat. No. 3,598,314 which is directed toward a "trapped volume" fuel injection valve, both of the above patents being assigned to the assignee of the present invention.

SUMMARY OF THE INVENTION

A fuel injection valve providing a relatively large accumulator capacity in comparison with the size of the valve is provided by employing a single chamber as both a valve chamber and an accumulator chamber. Opposed inlet and outlet valves alternately and intermittently communicate the single chamber with an inlet passage through which fuel under pressure is delivered and an outlet passage which is in further communication with a nozzle orifice.

In a preferred embodiment of the fuel injection valve, a dump valve is also provided to relieve fluid pressure from the chamber below a preselected pressure level in order to improve response of the injection valve.

Additional objects and advantages of the invention are made apparent in the following description having reference to the accompanying drawing.

DESCRIPTION OF THE DRAWING

The single drawing is a longitudinally sectioned view of a fuel injection valve constructed according to the present invention.

DESCRIPTION OF THE PREFERRED EMBODIMENT

The single FIGURE illustrates a fuel injection valve and nozzle combination 11 of the type employed within internal combustion engines for atomization of fuel and timed injection of the fuel as a spray into the engine cylinders. The fuel injection valve has an inlet passage 12 which is conventionally coupled with a fuel pump (not shown) suitable for delivering fuel under pulsating pressure. The fuel injection valve also includes a nozzle assembly 13 having outlet orifices 14 which may be conventionally associated with the respective cylinders of an engine (not shown).

The body of the fuel injection valve 11 is formed by a number of elements including an outer shell 16. An inlet plug member 17 forming the inlet passage 12 is secured within the shell 16, for example, by swaging. A threaded connector 18, an adapter element 19 and a dump valve unit 21 are secured in axial alignment with each other by means of a cylindrical case 22 adapted to fit within the shell 16.

An additional cylindrical case 23 is also secured to the dump valve unit 21, for example, by swaging, and extends downwardly to support a nozzle head 24 of the nozzle assembly 13. Once the various fuel injection valve and nozzle components are suitably arranged within the two case members 22 and 23, the assembly is secured within the shell 16 by threaded engagement of the member 17 and 18. An 0-ring 26 provides a suitable seal between the shell 16 and the case 23.

Fuel from the inlet passage 12 is communicated into a radially extending chamber 27 at the base of the dump valve unit 21 by means of an interconnecting passage 28 extending through the various intervening valve components. A cylindrical adapter 29 is arranged directly below the radially extending chamber 27 with a cylindrical spacer 31 extending between the adapter 29 and the nozzle head 24.

A single elongated chamber 32 is formed within the cylindrical extension 31 between the adapter 29 and the nozzle head 24. The chamber 32 acts as both a valve chamber and an accumulator chamber within the construction of the present invention. The adapter 29 forms an inlet passage 33 for communicating fuel from the chamber 27 to the elongated chamber 32. A conical valve seat 34 is formed at one end of the elongated chamber 32 about the inlet passage 33. An inlet valve member 36 has a mating spherical surface 37 adapted to engage the conical seat 34 and close off the inlet passage 33 from the chamber 32.

An outlet passage 38 is formed at the opposite end of the elongated chamber 32 in further communication with the orifices 14. A conical valve seat 39 is also formed about the outlet passage 38 to receive an inwardly opening needle valve 41. The needle valve member 41 is of a conventional inwardly opening type, at least to the extent that it is spaced apart from the nozzle head 24 in order to open in response to increasing fluid pressure differential between elongated chamber 32 and inlet passage 33. An axial extension 42 of the needle valve 41 extends upwardly and penetrates a bore 43 formed by the inlet valve member 36.

A spring 44 is arranged about the needle valve extension 42 for interaction between the needle valve member 41 and the inlet valve member 36 in order to assure alternate and intermittent opening of the two valves. As described in greater detail below, the single chamber 32 is thus placed either in communication with the inlet passage 33 to be charged with fuel under pressure or with the outlet passage 38 for the injection of fuel through the orifices 14.

In order to provide greater accumulator capacity within the valve assembly, the adapter 29 also forms an annular chamber 46 which is spaced apart from the inlet passage 33. The chamber 46 is in communication with the elongated chamber 32 by means of an intermediate passage 47 which is also formed by the adapter 29.

The components described immediately above and arranged toward the lower end of the injection valve assembly function together to provide an inwardly opening accumulator type valve having a relatively high accumulator capacity. As noted above, the needle valve 41 tends to open in response to increased pressure differential between elongated chamber 32 and inlet passage 33. Following intermittent injection of fuel, the needle valve 41 then tends to close as pressure differential diminishes between elongated chamber 32 and inlet passage 33. Inlet valve 36 may then open at the beginning of the next cycle to permit repressurization of the chamber 32 with fuel from the inlet passage 33.

It is desirable within such injection valves to provide a sharp cutoff after each injection cycle for better control over the engine with which the injection valve is associated. The present injection valve improves response of the needle valve 41 by relieving fluid pressure from the elongated chamber 32 and the extension chamber 46 below a selected pressure level. For that purpose, the elongated chamber 32 is in communication with the dump valve unit 21 by means of a passage 51 extending through the adapter 29 and into communication with a cross drilled passsage 52. The body 53 of the dump valve unit 21 also forms an axially off center bore 54 which slidably receives a dump valve spool 56. The spool 56 has an axial bore 57 which is in constant communication with the cross drilled passage 52 and accordingly the elongated chamber 32 by means of an annular groove 58 and an interconnecting passage 59. The lower end of the axial bore 57 is closed by a reaction piston 61 which has an enlarged head arranged within the radially extending chamber 27 in order to prevent the spool 56 from blocking off the inlet passage 33. A spring 62 in the upper end of the bore 54 tends to urge the spool 56 downwardly toward a position where an outlet passage 63 in communication with the axial passage 57 registers with a drain outlet passage 64 formed by the dump valve body 53. The passage 64 communicated with the interior of the shell 16 with fluid pressure being relieved from the shell 16 by means of drain passage indicated at 66.

The mode of operation for the accumulator valve and nozzle combination of the present invention is believed obvious from the preceding description of its various components. However, the preferred mode of operation for the valve and nozzle combination 11 is described in greater detail below in order to further clarify the invention.

As pulsating pressure from the pump (not shown) increases within the inlet passage 33, the inlet valve member 36 shifts downwardly against the spring 44 in order to admit fuel under pressure into the elongated chamber 32 and extension chamber 46. During this period, the needle valve 41 is urged downwardly into closing engagement with the valve seat 39. As fluid pressure differential between elongated chamber 32 and inlet passage 33 increases toward a preselected level, the needle valve 41 is urged upwardly to permit cummunication between the elongated chamber 32 and the orifices 14 to commence an injection stroke. With the needle valve 41 shifted upwardly against the spring 44, the inlet valve member 36 is urged upwardly into closing engagement against the valve seat 34.

The valve members 41 and 36 remain in this position until fluid pressure differential between elongated chamber 32 and inlet passage 33 drops below a preselected level at which the needle valve 41 is closed by the spring 44. Through proper timing, pulsating pressure tends to be simultaneously increasing within the inlet passage 33 so that the inlet valve 36 is also urged downwardly to permit repressurization of the elongated chamber 32 with fuel.

In order to improve response of the needle valve 41, the dump valve unit 21 functions to relieve fluid pressure from the elongated chamber 32 and the extension chamber 46 as it falls toward the pressure selected for closing of the needle valve 41. In accomplishing this purpose, it may be seen that the dump valve spool 56 is initially shifted upwardly by inlet pressure within chamber 27 which increases in cross sectional area immediately upon shifting of spool 56. Spool 56 is moving against a stop 67 is allowed to shift only enough to assure closure of drain passage 64. Its axial passage 57 and accordingly the elongated chamber 32 is thus blocked from the drain provided by the passages 63 and 64. As the elongated chamber 32 and the extension chamber 46 are pressurized with fuel, the dump valve spool 56 also tends to be urged upwardly toward the illustrated position by fluid pressure within its axial passage 57. Toward the end of each injection stroke, pressure diminishes within the axial passage 57. The spring 62, stop 67 and integral flange 68 are selected so that as pressure within the elongated chamber 32 falls toward a preselected level, the dump valve spool 56 is shifted downwardly in order to positively relieve fluid pressure from the chamber 32 by providing direct communication between spool passage 63 and drain passage 64 and accelerate closing response of the needle valve 41. As the next cycle begins pressure tends to be increasing within the inlet passage 33 so that the inlet valve 36 is opened and repressurization of the chambers 32 and 46 commences a new injection cycle. The dump valve spool 56 is also shifted upwardly into its illustrated position by fluid pressure within the chamber 27 in order to accomplish its function during the new cycle.

What is claimed is:

1. An accumulator type fuel injection valve comprising a cylindrical body forming an elongated chamber, an inwardly opening outlet valve means arranged at one end of the chamber for selectively and intermittently communicating the chamber with an injection orifice in response to fluid pressure in the chamber, inlet valve means arranged in another portion of the chamber, the inlet valve means selectively and intermittently communicating the chamber with an inlet passage while the outlet valve means is closed, and a dump valve for increasing responsiveness of the outlet valve means, the dump valve including a dump valve means communicating the chamber with a drain and an interacting spring means, the dump valve means tending toward a closed condition in response to fluid pressure in the chamber, the dump valve means tending to be opened by the spring means, and the spring means having a resilience selected to open the dump valve means when pressure in the chamber drops below a predetermined level.

2. The fuel injector valve of claim 1 wherein the outlet valve means is a needle valve.

3. The fuel injector valve of claim 1 wherein the elongated chamber acts as both a valve chamber and an accumulator chamber, the inlet passage being formed by a cylindrical member which is annularly spaced apart from the cylindrical valve body to form an extension of the elongated chamber.

4. The fuel injector valve of claim 1 wherein the dump valve means is also in communicaton with fluid from said inlet passage, the dump valve also tending to close in response to fluid pressure from the inlet passage.

5. An accumulator type fuel injection valve comprising:

a body forming an elongated chamber, an inlet passage and an outlet passage arranged in communication with injection nozzle means, fuel being present in the inlet passage under pulsating pressure;

inlet and outlet valve means associated respectively with the inlet and outlet passages while being operable in opposition to each other for alternately and intermittently communicating the chamber with the inlet and outlet passages, the outlet valve means tending to open in response to fluid pressure in the chamber, and a dump valve for relieving fluid from the chamber below a preselected pressure in order to increase responsiveness of the outlet valve means, the dump valve including dump valve means communicating the chamber with a drain and the dump valve means tending towards a closed condition in response to fluid pressure in the chamber, the dump valve means tending to be opened when pressure in the chamber drops below a predetermined level.

6. The fuel injector valve of claim 5 wherein the outlet valve means is an inwardly opening needle valve.

7. The fuel injector valve of claims 5 wherein the elongated chamber acts as both a valve chamber and an accumulator chamber, the inlet passage being formed as a centrally arranged axial passage, the body also forming an annular chamber around the inlet passage, the annular chamber being in communication with the elongated chamber to provide additional accumulator capacity.

8. The fuel injector valve of claim 5 wherein the dump valve means is in communication with fluid from said inlet passage, the dump valve also tending to be closed in response to fluid pressure from the inlet passage in order to assure that the dump valve means is closed prior to fluid pressurization of the elongated chamber.

* * * * *